US011685628B2

(12) United States Patent
Miyakawa et al.

(10) Patent No.: US 11,685,628 B2
(45) Date of Patent: Jun. 27, 2023

(54) POST-PROCESSING DEVICE AND LIQUID DISCHARGE DEVICE

(71) Applicant: SEIKO EPSON CORPORATION, Tokyo (JP)

(72) Inventors: Masayoshi Miyakawa, Suwa (JP); Hirohisa Adachi, Matsukawa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/449,194

(22) Filed: Sep. 28, 2021

(65) Prior Publication Data

US 2022/0098000 A1 Mar. 31, 2022

(30) Foreign Application Priority Data

Sep. 29, 2020 (JP) ..... 2020-162974

(51) Int. Cl.

| | |
|---|---|
| ***B65H 43/04*** | (2006.01) |
| ***B65H 35/00*** | (2006.01) |
| ***B41J 11/66*** | (2006.01) |
| ***B65H 35/06*** | (2006.01) |

(52) U.S. Cl.

CPC ..... *B65H 43/04* (2013.01); *B41J 11/663* (2013.01); *B65H 35/0086* (2013.01); *B65H 35/06* (2013.01); *B65H 2301/533* (2013.01)

(58) Field of Classification Search

CPC ..... B65H 2301/533

See application file for complete search history.

(56) References Cited

U.S. PATENT DOCUMENTS

| | | | | |
|---|---|---|---|---|
| 4,140,390 | A * | 2/1979 | Schultheis | G03B 27/521 83/61 |
| 4,205,769 | A * | 6/1980 | Blitchington | B65H 26/02 83/365 |
| 9,061,433 | B2 | 6/2015 | Nakamura | |
| 2010/0158597 | A1* | 6/2010 | Miyake | B26F 1/02 399/407 |

(Continued)

FOREIGN PATENT DOCUMENTS

| | | |
|---|---|---|
| CN | 103708272 | 4/2014 |
| CN | 107554060 | 1/2018 |

(Continued)

*Primary Examiner* — Jennifer Bahls
(74) *Attorney, Agent, or Firm* — Workman Nydegger

(57) ABSTRACT

Provided are a placement table configured to place a medium onto which liquid is discharged, a perforation member configured to perform perforation by imparting a shear force to the medium placed at the placement table, a die hole provided at the placement table, a perforation member moving section configured to move the perforation member between a standby position above the die hole and a perforating position at which the perforation member enters the die hole, and a control unit configured to control operation of the perforation member moving section, wherein when the control unit obtains perforation failure information during perforating operation in which the perforation member starts moving from the standby position and moves through the perforating position to the standby position, the control unit is configured to control the perforation member moving section so that a shear force is again imparted to the medium.

10 Claims, 6 Drawing Sheets

(56) References Cited

U.S. PATENT DOCUMENTS

| | | | | |
|---|---|---|---|---|
| 2010/0329755 | A1* | 12/2010 | Obuchi | B26F 1/14 399/361 |
| 2014/0093298 | A1 | 4/2014 | Nakamura | |
| 2018/0162674 | A1* | 6/2018 | Nakano | B65H 43/00 |
| 2020/0189872 | A1 | 6/2020 | Nakano | |

FOREIGN PATENT DOCUMENTS

| | | | | |
|---|---|---|---|---|
| EP | 1759821 | A1 * | 3/2007 | B26D 7/2614 |
| JP | 2018-095343 | A | 6/2018 | |
| WO | 2007/000804 | | 1/2009 | |

* cited by examiner

POST-PROCESSING DEVICE AND LIQUID DISCHARGE DEVICE

The present application is based on, and claims priority from JP Application Serial Number 2020-162974, filed Sep. 29, 2020, the disclosure of which is hereby incorporated by reference herein in its entirety.

BACKGROUND

1. Technical Field

The present disclosure relates to a post-processing device for performing perforation, as a post-processing, in a medium onto which liquid is discharged by a recording device such as an inkjet printer.

2. Related Art

JP-A-2018-95343 discloses a sheet processing device configured to punch or perforate a sheet by moving a punch blade to a punch position and performing perforation.

In a case where the sheet printed with an inkjet printer, etc. is to be perforated by the sheet processing device of JP-A-2018-95343, perforation failure may occur without being able to properly perforate the sheet. In a case where the perforation failure occurs, only a portion of the hole to be circular can be sheared, so that the perforated hole can may be a failure hole where chads remain adhered to the portion of the hole in the sheet. In a case where the chads remain adhered to the sheet, when the sheet is transported by moving the sheet through a transport path within or out of the device, there is a risk that the chads are dropped into the device, or the sheet may be caught during the transport, resulting in a transport failure.

SUMMARY

In order to solve the problems described above, a post-processing device according to the present disclosure includes a placement table configured to place a medium onto which liquid is discharged, a perforation member configured to perform perforation by imparting a shear force to the medium placed at the placement table, a die hole provided at the placement table, a perforation member moving section configured to move the perforation member between a standby position above the die hole and a perforating position at which the perforation member enters the die hole, and a control unit configured to control operation of the perforation member moving section, wherein when the control unit obtains perforation failure information during perforating operation in which the perforation member starts moving from the standby position and moves through the perforating position to the standby position, the control unit is configured to control the perforation member moving section so that a shear force is again imparted to the medium.

DESCRIPTION OF EXEMPLARY EMBODIMENTS

Figure 1:
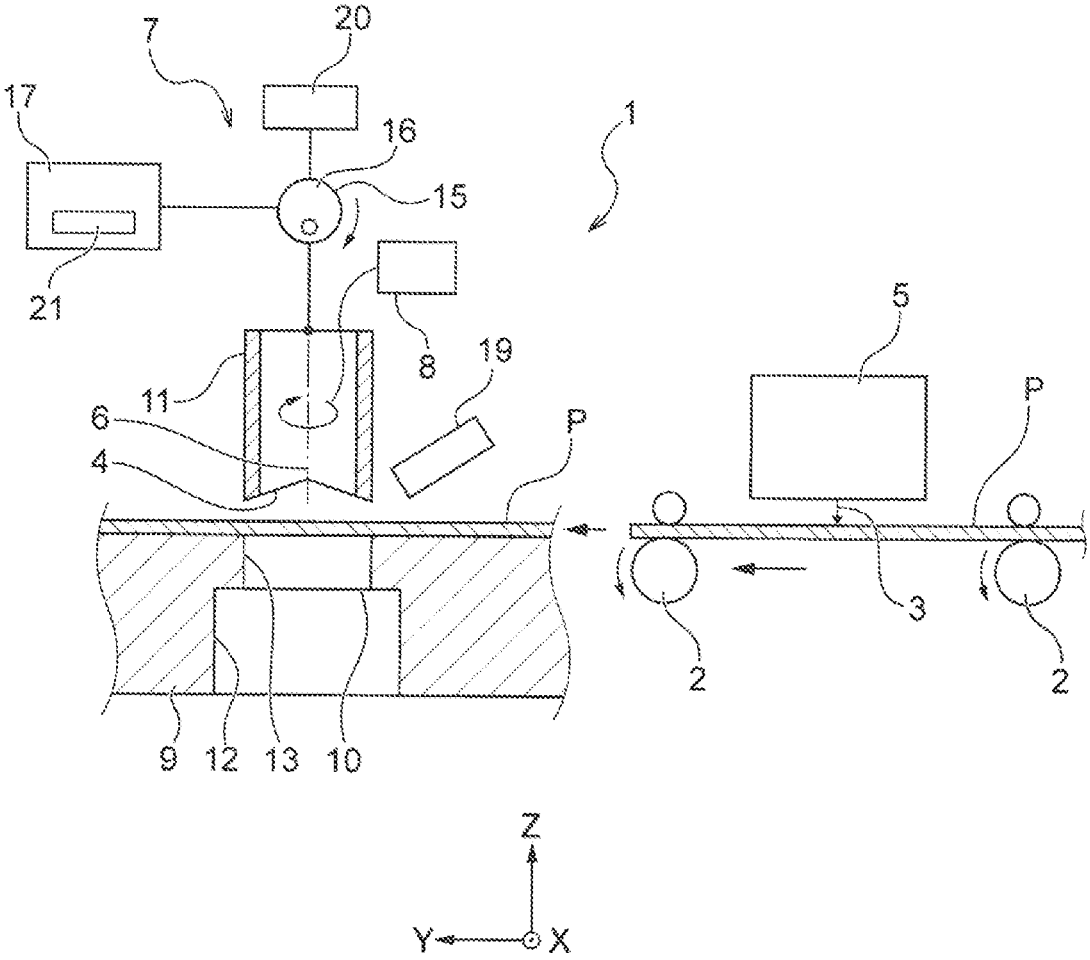
FIG. 1 is a vertical cross-sectional view illustrating a main configuration of a post-processing device according to a first exemplary embodiment.

First, the present disclosure will be schematically described.

A first aspect of a post-processing device according to the present disclosure for solving the above-described problems includes a placement table configured to place a medium onto which liquid is discharged, a perforation member configured to perform perforation by imparting a shear force to the medium placed at the placement table, a die hole provided at the placement table, a perforation member moving section configured to move the perforation member between a standby position above the die hole and a perforating position at which the perforation member enters the die hole, and a control unit configured to control movement of the perforation member moving section, wherein when the control unit obtains perforation failure information during perforating operation in which the perforation member starts moving from the standby position and moves through the perforating position to the standby position, the control unit is configured to control the perforation member moving section so that a shear force is again imparted to the medium.

Here, "during perforating operation" in "during perforating operation in which the perforation member starts moving from the standby position and moves through the perforating position to the standby position" is used in the present disclosure in a sense that the operation is based on total movement, and in addition to movement operation of returning to the standby position after the total movement, a case where the perforation member cannot perform the total movement and stops at the perforating position is included. Here, "total movement" means that the perforation member starts moving from the standby position and moves through the perforating position to the standby position.

In addition, "perforating position" of the perforation member refers to a position where the perforation member performs a series of entry/exit operation from the start of entering the die hole to the exit, and has a range.

In addition, "perforation failure" in "perforation failure information" is used in a sense that, in addition to the fact that the medium is not successfully perforated and the chads remain adhered to the medium, a case where the series of entry/exit operation of the perforation member from the start of entering the die hole to the exit at the perforating position are out of normal operating conditions is included. Examples of the latter perforation failure include, for example, a case where a speed of the perforating operation at the perforating position of the perforation member is slower than a regular normal state, a case where the speed is irregular, or a case where the perforating operation is stopped in the middle.

Furthermore, "perforation failure information" refers to information corresponding to the "perforation failure". For example, the information when the perforation member is post-treated, that is, when it is determined that the perforated medium is not successfully perforated based on an image of a perforation site of the perforated medium, can be utilized as information corresponding to the perforation failure. Further, the amount of change when a control signal in the control unit that controls the movement of the perforation member during the perforating operation changes from the regular normal state, or data when sensing data different from the sensing data during normal operation is sensed in the sensing data obtained by detecting the movement state of the perforation member during perforating operation with a sensor, etc. can be utilized as information corresponding to the perforation failure.

In addition, "shear force is imparted" in "shear force is again imparted" means that the perforation member is moved toward the lowest position of the die hole to act on the medium with the force to perforate the medium.

According to the present aspect, when the control unit obtains the perforation failure information during perforating operation in which the perforation member starts moving from the standby position and moves through the perforating position to the standby position, the control unit is configured to control the perforation member moving section so that the shear force is again imparted to the medium. As a result, the shear force is again imparted at the same position to the failure hole where the medium is not successfully perforated and the chads adhere to the medium and remain, whereby the chads adhering to the medium can be easily removed, and the medium can be easily changed into a medium in which a normal hole is formed.

In addition, when transporting the post-treated medium into or out of the device, it is possible to reduce the risk that the chads are dropped into the device or the chads get caught during transport to cause the transport failure.

In a case where a medium onto which liquid such as ink is discharged is perforated with the perforation member, when the medium contains water, the perforation failure is more likely to occur than in a dry state. The present aspect is particularly effective when perforating such a medium onto which liquid is discharged with the perforation member.

Here, in the first aspect, when the control unit obtains perforation failure information during the perforating operation of the perforation member, the control unit may control the perforation member moving section so that the shear force is again imparted to the medium without returning the perforation member to the standby position.

Here, "when the control unit obtains perforation failure information during the perforating operation of the perforation member" means that the perforation failure information can be obtained at each point in time before the perforation member reaches the lowest position in the movement range at the perforating position, after reaching the lowest position, and at the time when the lowest position is reached.

Furthermore, "without returning the perforation member to the standby position" is used in a sense including both a case where the perforation member is lowered from a position where the perforation member has stopped and lowered directly toward the lowest position, and a case where when the perforation member is temporarily raised and then lowered. Here, the "temporarily raised" means a movement within a range that does not allow the raise to the standby position.

In this way, when the control unit obtains perforation failure information during the perforating operation of the perforation member, the shear force is again imparted to the medium without returning the perforation member to the standby position. As a result, an increase in the perforation process or the post-processing time can be suppressed.

In addition, in a configuration where the shear force is again imparted to the medium without returning the perforation member to the standby position when the control unit obtains perforation failure information during the perforating operation of the perforation member, the control unit may be configured to: control the perforation member moving section so that the shear force is again imparted by moving the perforation member toward the lowest position in a forward direction, when the perforation failure information is received before the perforation member reaches the lowest position; and control the perforation member moving section so that the shear force is again imparted by moving the perforation member toward the lowest position in a reverse direction, when the perforation failure information is received after the perforation member reaches the lowest position.

As a result, the shear force can be imparted again appropriately in accordance with the timing at which the perforation failure information is obtained.

A post-processing device according to a second aspect of the present disclosure is the post-processing device according to the first aspect, wherein when the control unit obtains the perforation failure information, the control unit is configured to control the perforation member moving section so that a shear force is again imparted to the medium after a preset first period of time elapsed since the perforation failure information was obtained.

According to the present aspect, when the control unit obtains the perforation failure information, the shear force is again imparted to the medium after the preset first period of time elapsed since the perforation failure information was obtained. As a result, the medium onto which the liquid is discharged is dried while the first period of time elapses, and thus an effect is obtained in which the chads are easily removed by imparting the shear force again.

A post-processing device according to a third aspect of the present disclosure is the post-processing device according to the second aspect, wherein when the control unit obtains second perforation failure information upon imparting a shear force again to the medium after the first period of time elapsed, the control unit is configured to control the perforation member moving section so that a shear force is again imparted to the medium after a preset second period of time elapsed since the second perforation failure information was obtained.

According to the present aspect, when the second perforation failure information is obtained, the shear force is again imparted to the medium after the preset second period of time elapsed since the second perforation failure information was obtained. As a result, the medium onto which the liquid is discharged is further dried while the second period of time elapses, and thus an effect is obtained in which the chads are easily removed by imparting the shear force again thereafter.

A post-processing device according to a fourth aspect of the present disclosure is the post-processing device according to the third aspect, wherein the second period of time is longer than the first period of time.

According to the present aspect, the second period of time is longer than the first period of time, so the drying time after obtaining the second perforation failure information is greater than the first drying time, whereby the shear force is subsequently imparted again thereafter to obtain an effect of facilitating removal of the chads.

A post-processing device according to a fifth aspect of the present disclosure is the post-processing device according to the third aspect or the fourth aspect, wherein the control unit is adjustable according to the amount of the liquid discharged onto the medium for the first period of time and the second period of time.

According to the present aspect, the first period of time and the second period of time can be adjusted according to an amount of the liquid discharged onto the medium. As a result, the drying time can be determined according to the amount of moisture of the medium, which makes it easier to remove the shear debris.

A post-processing device according to a sixth aspect of the present disclosure is the post-processing device according to any one of the first to fifth aspects, including a drying mechanism for drying the medium, wherein the control unit is configured to control the drying mechanism, and control, when the control unit obtains perforation failure information during the perforating operation of the perforation member, the perforation member moving section so that a shear force is again imparted to the medium after drying the medium by the drying mechanism.

According to the present aspect, the drying mechanism for drying the medium is provided, and the shear force is again imparted after the medium has been dried by the drying mechanism. As a result, the medium in a wet state with liquid can be actively dried by the drying mechanism, which makes it easier to remove the shear debris.

A post-processing device according to a seventh aspect of the present disclosure is the post-processing device according to any one of the first to sixth aspects, wherein the perforation member is provided rotatably and displaceably around an axis, and when the control unit obtains perforation failure information during the perforating operation of the perforation member, the control unit is configured to control the perforation member moving section so that a shear force is again imparted to the medium after the perforation member is rotatably displaced.

According to the present aspect, the perforation member is provided rotatably and displaceably around the axis, and the shear force is again imparted after rotatably displacing the perforation member. This makes it easier to remove the chads because the position at which the perforation member hits the failure hole is changed before the rotational displacement.

A post-processing device according to an eighth aspect of the present disclosure is the post-processing device according to any one of the first to seventh aspects, wherein the control unit is configured to change a movement speed of the perforation member by controlling the perforation member moving section, and control, when the control unit obtains perforation failure information during the perforating operation of the perforation member, the perforation member moving section so that a shear force is again imparted to the medium by moving the perforation member at a movement speed faster than a movement speed before the perforation failure information is obtained.

According to the present aspect, the shear force is imparted again by changing the movement speed of the perforation member to a movement speed that is faster than before the perforation failure information is obtained. This makes it easier to remove chads.

A post-processing device according to a ninth aspect of the present disclosure is the post-processing device according to any one of the first to eighth aspects, wherein the control unit selectably includes a different location perforation mode in which the medium is perforated at a location different from a perforation location when the control unit obtains the perforation failure information.

According to the present aspect, the control unit selectably includes the different location perforation mode in which the medium is perforated at the location different from the perforation location when the control unit obtains the perforation failure information. In this way, when a user desires that a medium having a perforation failure is a lost sheet, it is possible to easily perform the loss sheet processing by selecting the different location perforation mode.

A liquid discharge device according to a tenth aspect of the present disclosure includes a discharge unit configured to discharge liquid onto a medium to be transported, and a post-processing device configured to perforate the medium onto which the liquid is discharged by the discharge unit, wherein the post-processing device is according to any one of the first to ninth aspects.

According to the present aspect, the effect of each aspect of the post-processing device can be obtained as a liquid discharge device.

First Exemplary Embodiment

Hereinafter, a liquid discharge device including a post-processing device according to a first exemplary embodiment of the present disclosure will be described in detail based on FIGS. 1 to 3.

In the following description, three mutually orthogonal axes are denoted as an X-axis, a Y-axis, and a Z-axis, respectively, as illustrated in the drawings. The Z-axis direction corresponds to a vertical direction (a direction in which gravity acts). The X-axis direction and the Y-axis direction correspond to a horizontal direction. Here, the Y-axis direction corresponds to a transport direction of a medium, and the X-axis direction corresponds to a width direction of the medium intersecting the transport direction.

Figure 2:
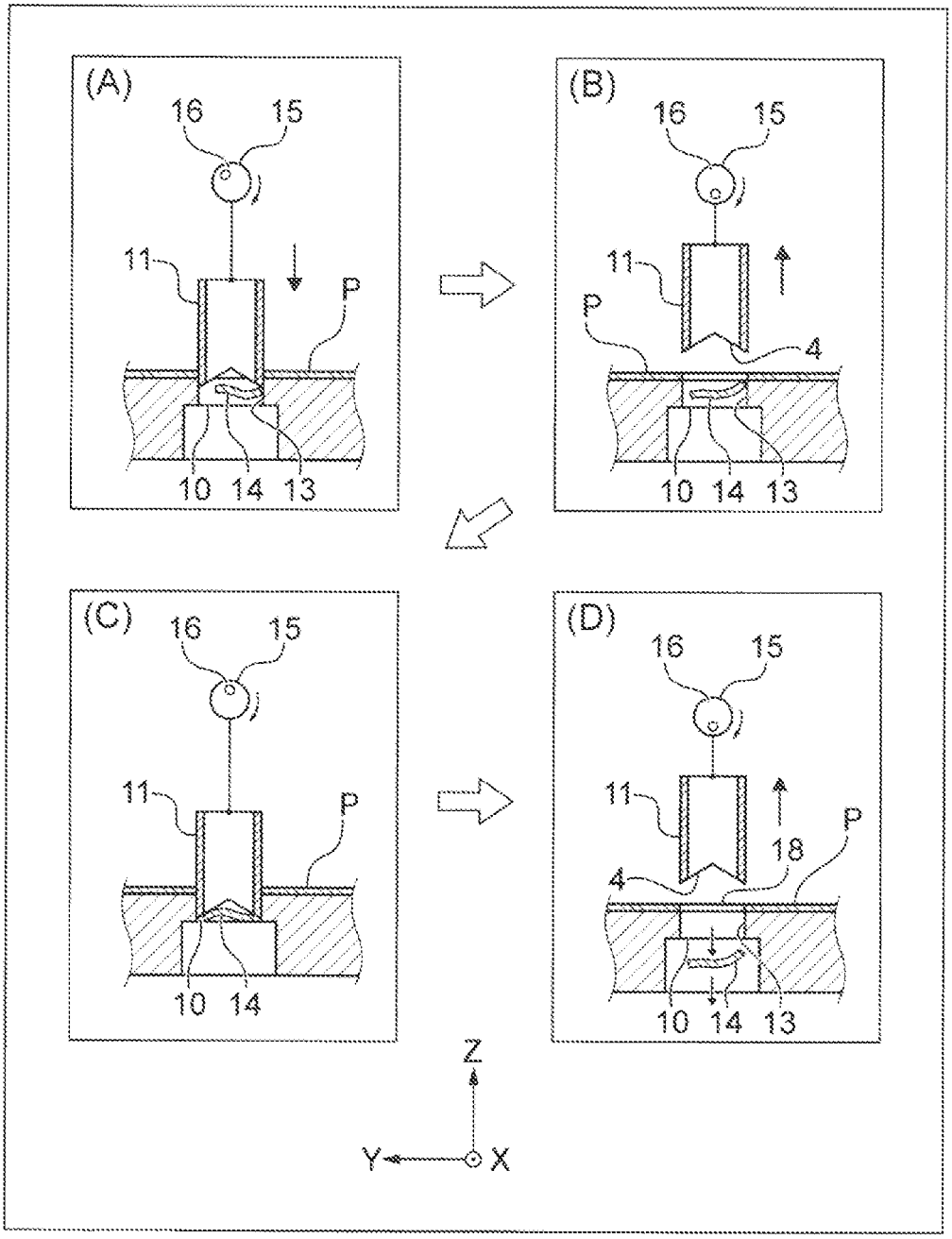
FIG. 2 is a longitudinal cross-sectional view illustrating perforating operation of the post-processing device according to the first exemplary embodiment.

As illustrated in FIG. 1, a liquid discharge device 1 according to the present exemplary embodiment includes a discharge unit 5 configured to discharge liquid 3 onto a medium P transported by a transport unit 2, and a post-processing device 7 configured to perforate the medium P onto which the liquid 3 has been discharged by the discharge unit 5.

Discharge Unit

The discharge unit 5 is a recording head for an inkjet printer in the present exemplary embodiment. The recording head, which is the discharge unit 5, records various types of information by discharging ink, which is an example of the liquid 3, onto the medium P such as a single paper sheet. Of course, the discharge unit 5 is not limited to the recording head.

The transport unit 2 uses a nip roller from a pair of a driving roller and a driven roller. The medium P, onto which the liquid 3 has been discharged by the discharge unit 5, is transported and passed through a medium transport path, which is not illustrated, and is placed at a placement table 9, which will be described later, of the post-processing device 7. In FIG. 1, only two sets of the transport units 2 are illustrated on the upstream and the downstream of the discharge unit 5 in the Y-axis direction, which is the transport direction of the medium P.

As illustrated in FIG. 1, the post-processing device 7 according to the present exemplary embodiment includes the placement table 9 that places the medium P onto which the liquid 3 has been discharged, a perforation member 11 that performs perforation by imparting shear force to the medium P placed at the placement table 9, a die hole 13 provided at the placement table 9, a perforation member moving section 15 that moves the perforation member 11 between a standby position above the die hole 13 (position in FIG. 1) and a perforating position at which the perforation member 11 enters the die hole 13, and a control unit 17 that controls movement of the perforation member moving section 15.

When the control unit 17 obtains perforation failure information during single perforating operation in which the perforation member 11 starts moving from the standby position and moves through the perforating position to the standby position, the control unit 17 is configured to control the perforation member moving section 15 so that the shear force is again imparted to the medium P.

Perforation Member, Placement Table, Die Hole

The perforation member 11, in the present exemplary embodiment, is of a normal construction of a cylindrical structure having a perforating blade 4 on a tip thereof. In FIG. 1, a reference sign 6 denotes an axial core wire of the perforation member 11. In the present exemplary embodiment, the perforation member 11 is configured to be rotatably displaceable around the axial core wire 6 by a rotation mechanism 8. "Rotatably displaceable" means not merely rotating, but means, for example, stopping by rotating the perforation member 11 around the axial core wire 6 at an angle of 90 degrees or 45 degrees. It is sufficient that the rotation mechanism 8 be a structure capable of rotatably displacing the perforation member 11, and a known structure can be used.

Note that the perforation member 11 may have a non-rotating structure that does not include the rotation mechanism 8.

The die hole 13 is formed at the placement table 9, and the perforation member 11 moves during the perforating operation, and the perforating blade 4 at the tip thereof enters the die hole 13. This entry imparts the shear force to the medium P. A circular hole 18 (FIG. 2D) is formed at the medium P by normal perforating operation, and chads 14 are separated, as illustrated in FIGS. 2C and 2D. Below the die hole 13 is in communication with an ejection hole 12. The ejection hole 12 causes the chads 14 generated by the perforation to be ejected to the outside.

Note that the above structure of the die hole 13 is merely an example, and is not limited to a structure described above including the ejection hole 12.

A portion of the perforating blade 4 of the perforation member 11 moves to a lowermost portion 10 of the die hole 13 (position in FIG. 2C), and then returns to the above standby position (position in FIG. 1). In other words, the perforation member 11 is configured to reciprocate between the standby position (position in FIG. 1) and the lowermost portion 10 of the die hole 13 as the lowest position.

Perforation Member Moving Section

The perforation member moving section 15 moves the perforation member 11 between the standby position and the lowest position in the perforating position at which the perforation member 11 enters the die hole 13. In the present exemplary embodiment, the movement of the perforation member 11 is achieved by rotation of an eccentric cam 16. A rotational force of a drive source, such as a motor, which is not illustrated, is transmitted to the eccentric cam 16 via a power transmission mechanism.

Note that the perforation member moving section 15 is not limited to a structure using the eccentric cam 16 as a specific structure thereof.

Control Unit

When the control unit 17 obtains perforation failure information during the perforating operation in which the perforation member 11 starts moving from the standby position and moves through the perforating position to the standby position, the control unit 17 is configured to control the perforation member moving section 15 so that the shear force is again imparted to the medium P.

Here, "during perforating operation" in "during perforating operation in which the perforation member 11 starts moving from the standby position and moves through the perforating position to the standby position" is used in the present disclosure in a sense that the operation is based on total movement, and in addition to movement operation of returning to the standby position after the total movement, a case where the perforation member 11 cannot perform the total movement and stops at the perforating position is included. Here, "total movement" means that the perforation member 11 starts moving from the standby position and moves through the perforating position to the standby position.

In addition, the "perforating position" refers to a position of an area where the perforation member 11 performs a series of entry/exit operation from the start of entering the die hole 13 to the exit, and has a range.

In addition, "shear force is imparted" means that the perforation member 11 is moved toward the lowest position of the die hole 13 to act on the medium P with the force to perforate the medium P. The strength of the shear force is set in advance, but the strength may be changed.

In the present exemplary embodiment, when the perforation failure information is a type of information in a case where the perforation member 11 cannot perform the total movement and stops at the perforating position in the perforating operation, the perforation member 11 is configured to be temporarily returned to the standby position and then lowered to impart the shear force again to the medium P.

The operation of temporarily returning the perforation member 11 to the standby position is performed by turning off the power of the drive source of the perforation member moving section 15, changing to a state for raising the perforation member 11, and then turning on the power. When the perforation member 11 cannot be returned to the standby position, a failure error occurs.

In addition, "perforation failure" in "perforation failure information" is used in a sense that, in addition to the fact that the medium P is not perforated to be the normal hole 18 and the chads 14 remain adhered to the medium P, a case where the series of entry/exit operation of the perforation member 11 from the start of entering the die hole 13 to the exit at the perforating position are out of normal operating conditions is included. Examples of the latter perforation failure include, for example, a case where a speed of the perforating operation at the perforating position of the perforation member 11 is slower than a regular normal state, a case where the speed is irregular, or a case where the perforating operation is stopped in the middle.

Furthermore, "perforation failure information" refers to information corresponding to the "perforation failure". For example, the information when the perforation member 11 is post-treated, that is, when it is determined that the normal hole 18 is not formed based on an image of a perforation site of the perforated medium 11, can be utilized as information corresponding to the perforation failure. Further, the amount of change when a control signal in the control unit 17 that controls the movement of the perforation member 11 during the perforating operation changes from the regular normal state, or data when sensing data different from the sensing data during normal operation is sensed in the sensing data obtained by detecting the movement state of the perforation member 11 during perforating operation with a sensor (not illustrated), etc. can be utilized as information corresponding to the perforation failure.

Examples of this sensor include a structure in which a position sensor capable of detecting the position of the perforation member 11 is provided at the top and bottom of the movable range of the perforation member, respectively.

Drying Mechanism

As illustrated in FIG. 1, in the present exemplary embodiment, the post-processing device 7 includes a drying mechanism 19 that dries the medium P. The drying mechanism 19 is provided near the top of the die hole 13. It is sufficient that the drying mechanism 19 be capable of drying the perforation site of the medium P, and infrared drying, dry air drying, and heat generated by a drive source such as a motor located in the vicinity can be utilized.

The control unit 17 is configured to control the drying mechanism 19, and when the control unit 17 obtains the perforation failure information during the perforation member 11 is in the perforating position, the control unit 17 is configured to control the perforation member moving section 15 so that the shear force is again imparted to the medium P after drying the perforation site of the medium P by the drying mechanism 19.

Note that the post-processing device 7 may have a structure that does not include the drying mechanism 19.

Speed Adjustment Mechanism

As illustrated in FIG. 1, in the present exemplary embodiment, a speed adjustment mechanism 20 is provided at the perforation member moving section 15. The speed adjustment mechanism 20 can adjust the movement speed of the perforation member 11, and includes a switchable gear train provided at the power transmission mechanism, etc.

The control unit 17 is configured to change the movement speed of the perforation member 11 by controlling the speed adjustment mechanism 20 of the perforation member moving section 15. Then, in the present exemplary embodiment, in a case where the perforation failure information is obtained when the perforation member 11 is in the perforating position, the control unit 17 is configured to control the speed adjustment mechanism 20 of the perforation member moving section 15 so that the shear force is again imparted to the medium P by moving the perforation member 11 at a movement speed faster than a movement speed before the perforation failure information is obtained.

Note that a structure in which the speed adjustment mechanism 20 is not provided at the perforation member moving section 15 may be used.

Different Location Perforation Mode

As illustrated in FIG. 1, in the present exemplary embodiment, the control unit 17 selectably includes a different location perforation mode 21 in which the medium P is perforated at a location different from a perforation location when the control unit 17 obtains the perforation failure information. When this different location perforation mode 21 is selected, the shear force is not imparted again, and loss sheet processing is performed. This loss sheet processing is a process for perforating a hole in a place different from the original perforation location to form a hole to indicate that the sheet is lost, in order to notify the user that the medium P has a perforation failure in an easy-to-understand manner.

This loss sheet processing can be performed by providing a loss sheet perforation member for separately from the perforation member 11 for original perforation, and forming the hole by moving the loss sheet perforation member when the control unit 17 obtains the perforation failure information. Alternatively, when the perforation failure information is obtained, the loss sheet processing can be performed by moving the medium P at the placement table 9 slightly to one side in the transport direction to form a hole for the sheet loss at another location.

Note that the post-processing device 7 may have a structure that does not include the different location perforation mode 21.

Description on Actions of First Exemplary Embodiment

Next, actions of the first exemplary embodiment will be described based on FIGS. 1 to 3.

Figure 3:
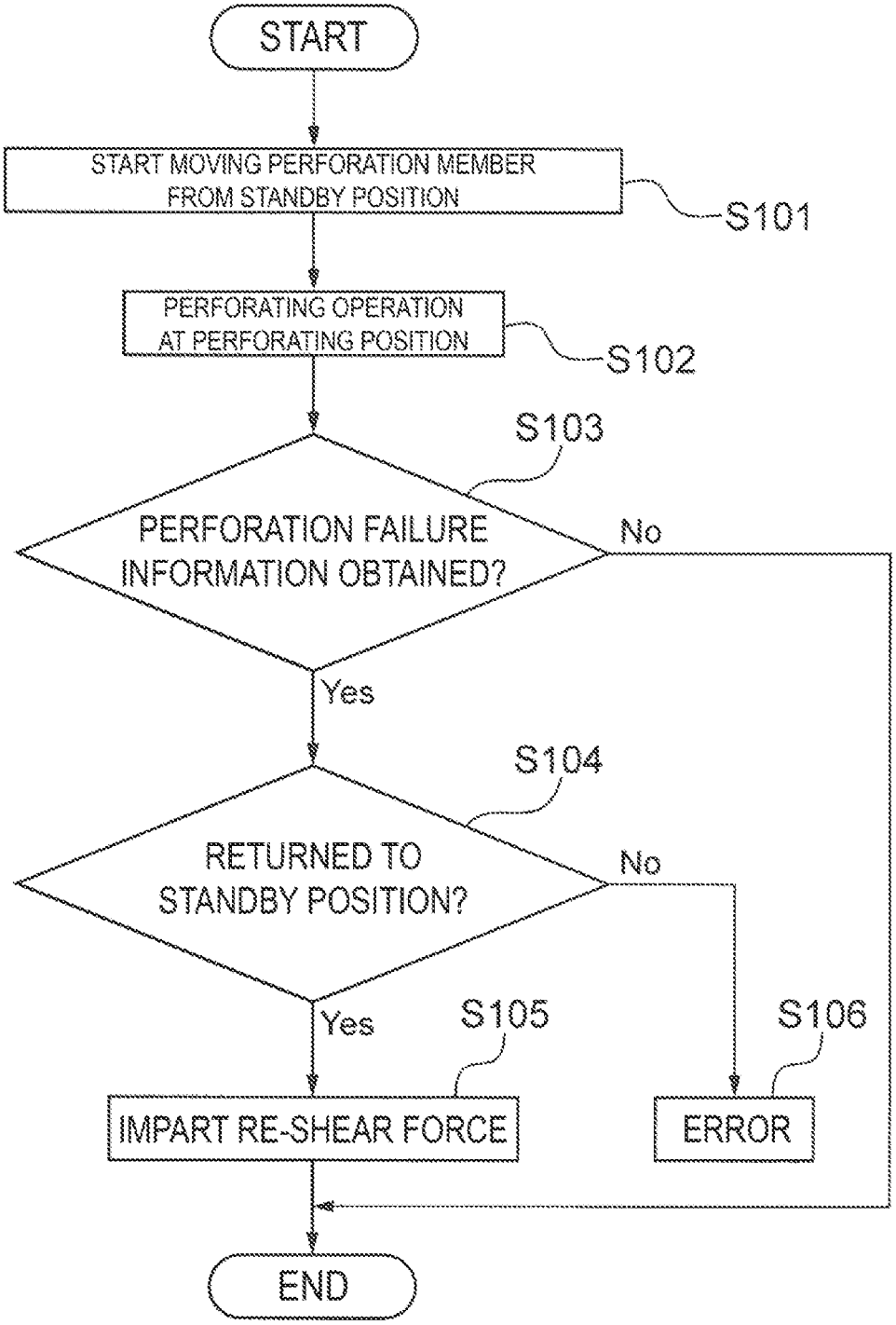
FIG. 3 is a flowchart illustrating the perforating operation of the post-processing device according to the first exemplary embodiment.

The control unit 17 starts moving the perforation member 11 from the standby position in FIG. 1 toward the die hole 13 in step S101 in the flowchart of FIG. 3. The perforation member 11 reaches the inlet of the die hole 13 to perform the perforating operation in which the hole is pierced with respect to the medium P. That is, in step S102, the perforation member 11 performs the perforating operation at the perforating position.

Next, in step S103, it is determined whether the control unit 17 has obtained the perforation failure information during the perforating operation. When perforation failure information has not been obtained, the perforation was performed to form the normal hole 18, and the perforation is completed.

When, in step S103, the control unit 17 has obtained the perforation failure information, it is determined in step S104 whether the perforation member 11 could pass through the perforating position and return to the standby position. When the perforation member 11 could return to the standby position, the process proceeds to step S105 in which the shear force is again imparted.

On the other hand, as illustrated in FIG. 2A, in a case where the perforation member 11 stops during the perforating operation, the control unit 17 controls the perforation member moving section 15 so that the perforation member 11 is returned to the standby position as described above. As a result, as illustrated in FIG. 2B, when the perforation member 11 could be raised and returned to the standby position, the process proceeds to step S105 in which the shear force is again imparted.

As a result, as illustrated in FIGS. 2C and 2D, the perforation member 11 is moved to the lowest position to detach the shear debris 14 from the medium P (FIG. 2C), and then rises back to the standby position (FIG. 2D).

In step S104, when the perforation member 11 does not rise even if processing is performed to raise the perforation member 11 (FIG. 2B) that has stopped at the perforating position, the process proceeds to step S106 where an error is caused to notify the user of the failure.

Description on Effects of First Exemplary Embodiment (1) According to the present exemplary embodiment, when the control unit 17 obtains perforation failure information during the perforating operation in which the perforation member 11 starts moving from the standby position and moves through the perforating position to the standby position, the control unit 17 is configured to control the perforation member moving section 15 so that the shear force is again imparted to the medium P. As a result, the shear force is again imparted at the same position to the failure hole where the medium P is not successfully perforated and the chads 14 adhere to the medium P and remain, whereby the chads 14 adhering to the medium P can be easily removed, and the medium can be easily changed into the medium P in which the normal hole 18 is formed.

In addition, when transporting the post-treated medium P into or out of the device, it is possible to reduce the risk that the chads 14 are dropped into the device or the chads 14 get caught during transport to cause the transport failure.

In a case where the medium P onto which liquid 3 such as ink is discharged is perforated with the perforation member 11, when the medium P contains water, the perforation failure is more likely to occur than in a dry state. The present aspect is particularly effective when perforating such a medium P onto which the liquid 3 is discharged with the perforation member 11.

(2) In the present exemplary embodiment, when the post-processing device 7 is a structure including the drying mechanism 19 for drying the medium P, the shear force can be imparted after the medium P has been dried by the drying mechanism 19. As a result, the medium P in a wet state with the liquid 3 can be actively dried by the drying mechanism 19, which makes it easier to remove the shear debris 14.

(3) In the present exemplary embodiment, when the post-processing device 7 is a structure including the perforation member 11 that is rotatably displaceable around the axis, the shear force is again imparted after rotatably displacing the perforation member 11. This makes it easier to remove the chads 14 because the position at which the perforation member 11 hits the failure hole the perforating blade 4 is changed before the rotational displacement.

(4) In the present exemplary embodiment, in a case where the control unit 17 selectably includes a different location perforation mode 21 in which the medium P is perforated at a location different from a perforation location when the control unit 17 obtains the perforation failure information, the following is possible.

When a user desires that the medium P having a perforation failure is a lost sheet, it is possible to easily perform the loss sheet processing by selecting the different location perforation mode 21.

Second Exemplary Embodiment

Figure 4:
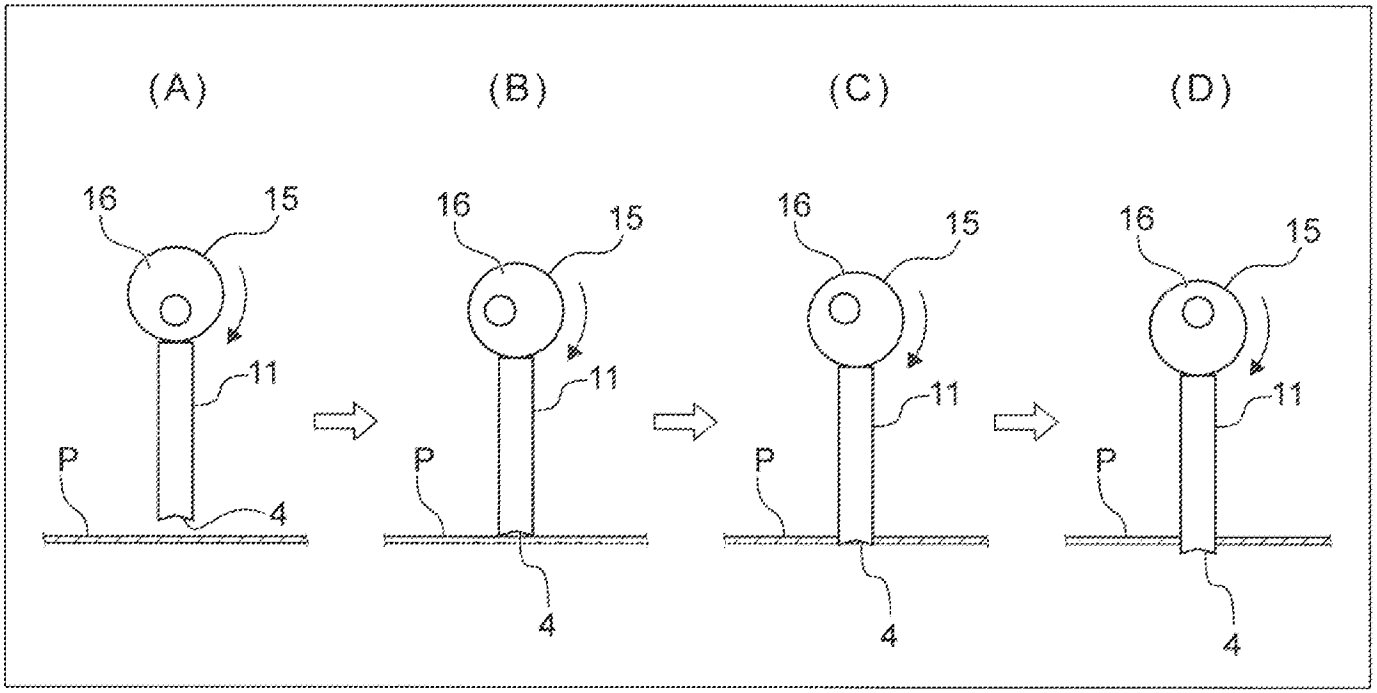
FIG. 4 is a vertical cross-sectional view illustrating perforating operation of a post-processing device according to a second exemplary embodiment.
Figure 5:
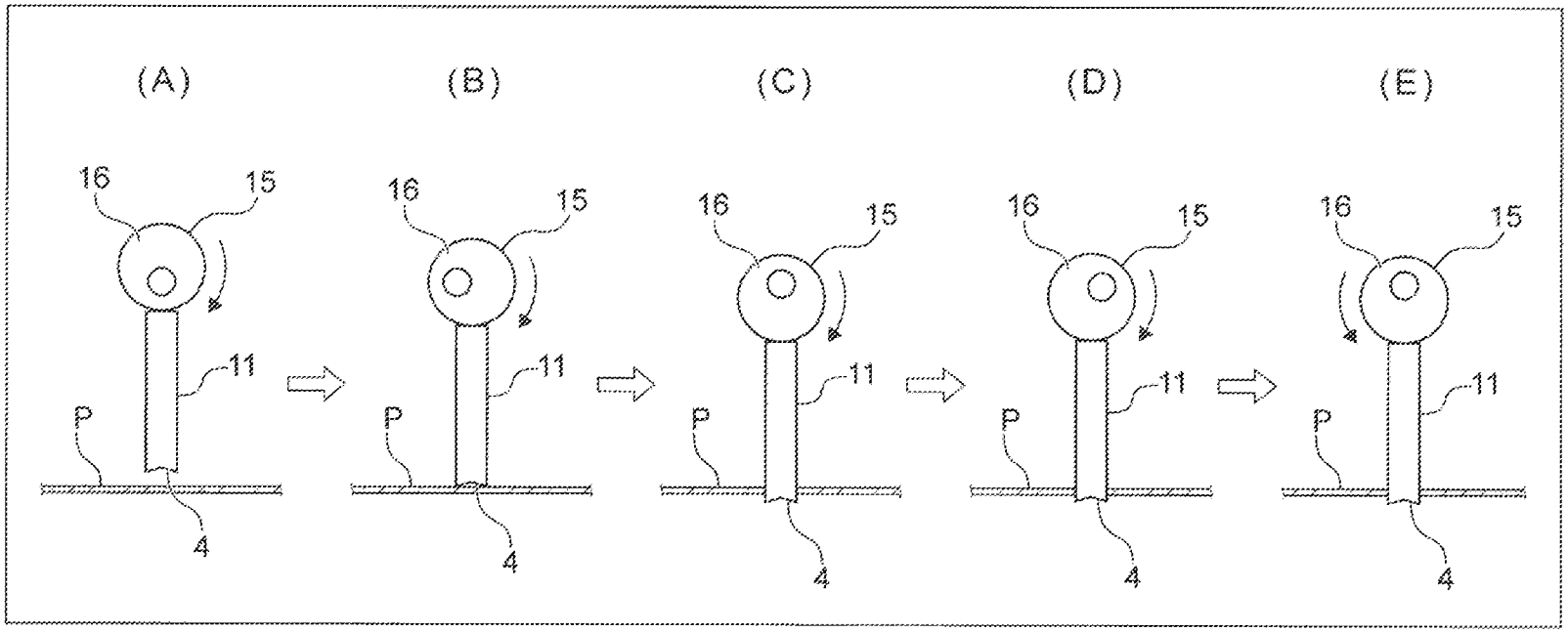
FIG. 5 is a vertical cross-sectional view illustrating the perforating operation of the post-processing device according to the second exemplary embodiment.

Hereinafter, a post-processing device according to a second exemplary embodiment of the present disclosure will be described in detail based on FIGS. 4 to 5. FIGS. 4 and 5 describe only the perforation member 11, the perforation member moving section 15, and the medium P placed at the placement table 9 within the components of the post-processing device 7, and the description of other components including the placement table 9 is omitted. Furthermore, a shape of the perforation member 11 is also simply described.

Furthermore, the same actions and effects as those of the first exemplary embodiment will be omitted.

In the present exemplary embodiment, in a case where the perforation failure information is obtained when the perforation member 11 is in the perforating position, the control unit 17 controls the perforation member moving section 15 so that the shear force is again imparted to the medium P without returning the perforation member 11 to the standby position.

Here, the case where the perforation failure information is obtained when the perforation member 11 is in the perforating position means that the perforation failure information can be obtained at each point in time before the perforation member 11 reaches the lowest position in the movement range at the perforating position, after reaching the lowest position, and at the time when the lowest position is reached.

Furthermore, "without returning the perforation member 11 to the standby position" is used in a sense including both a case where the perforation member 11 is lowered from a position where the perforation member 11 has stopped and lowered directly toward the lowest position, and a case where when the perforation member 11 is temporarily raised and then lowered.

Here, the "temporarily raised" means a movement within a range that does not allow the raise to the standby position. When the perforation member 11 has stopped at the point where the lowest position is reached, the above "temporarily raised" operation is performed and then lowered. Even when the perforation member 11 stops at a position other than the lowest position, when the stopped position is a position where the distance to the lowest position is short and the required amount of shear force is not caused, the perforation member 11 will move down after performing the "temporarily raised" operation. Whether or not the perforation member 11 is "temporarily raised" is configured to be pre-tabled and executed in response to the position in which the perforation member 11 stops.

Note that the information of the position where the perforation member 11 has stopped with the perforation failure can be obtained based on the sensor, image, etc. described above.

In the present exemplary embodiment, the control unit 17 is configured to control the perforation member moving section 15 so that the shear force is again imparted by moving the perforation member 11 toward the lowest position in a forward direction, when the perforation failure information is received before the perforation member 11 reaches the lowest position, and control the perforation member moving section 15 so that the shear force is again imparted by moving the perforation member 11 toward the lowest position in a reverse direction, when the perforation failure information is received after the perforation member 11 reaches the lowest position.

A specific description will be given below based on FIG. 4 and FIG. 5.

A case where the perforation failure information is received before the perforation member reaches the lowest position FIGS. 4A to 4D correspond to a case where the perforation failure information is received before the perforation member 11 reaches the lowest position. From the state in which the perforation member 11 is in the standby position, the eccentric cam 16 of the perforation member moving section 15 rotates and the downward movement is started. (B) indicates when the perforating blade 4 of the perforation member 11 reaches the surface of the medium P. The following (C) is a point before the perforation member 11 reaches the lowest position, and it is assumed that the perforation member 11 has stopped at the position (C) due to the perforation failure.

By receiving the perforation failure information in which the perforation member 11 stops at the position of (C), the control unit 17 imparts again the shear force to the medium P without returning the perforation member 11 to the standby position (position (A)) (FIG. 4D).

Specifically, when the perforation failure information is received, the control unit 17 drives the perforation member moving section 15, and as illustrated in FIG. 4D, restarts the movement of the perforation member 11 from the stopped position, and imparts the shear force again.

A case where the perforation failure information is received after the perforation member reaches the lowest position FIGS. 5A to 5E correspond to a case where the perforation failure information is received after the perforation member 11 reaches the lowest position. From the state in which the perforation member 11 is in the standby position, the eccentric cam 16 of the perforation member moving section 15 rotates and the downward movement is started. (B) indicates when the perforating blade 4 of the perforation member 11 reaches the surface of the medium P. The following (C) indicates when the perforation member 11 has reached the lowest position. As the eccentric cam 16 rotates as is, the perforation member 11 starts to rise. The following (D) is a point after the perforation member 11 rises a little after reaching the lowest position, and it is assumed that the perforation member 11 has stopped at the position (D) due to the perforation failure.

By receiving the perforation failure information in which the perforation member 11 stops at the position of (D), the control unit 17 imparts the shear force again to the medium P without returning the perforation member 11 to the standby position (position (A)) (FIG. 5E).

Specifically, when the perforation failure information is received, the control unit 17 moves the perforation member 11 by changing the eccentric cam 16 of the perforation member moving section 15 into a state of rotating in the opposite direction. As a result, as illustrated in FIG. 5E, the movement from the stopped position toward the lowest position of the perforation member 11 is resumed, and the shear force is again imparted.

Description on Effects of Second Exemplary Embodiment (1) According to the present exemplary embodiment, in a case where the perforation failure information is obtained when the perforation member 11 is in the perforating position, the shear force is again imparted to the medium P without returning the perforation member 11 to the standby position. As a result, an increase in the perforation process or the post-processing time can be suppressed.

(2) Further, in the present exemplary embodiment, the control unit 17 separately imparts the shear force again when the perforation failure information is received before the perforation member reaches the lowest position, and when received after reaching the lowest position. As a result, the shear force can be imparted again appropriately in accordance with the timing at which the perforation failure information is obtained.

Third Exemplary Embodiment

Hereinafter, a post-processing device according to a third exemplary embodiment of the present disclosure will be described in detail based on FIG. 6. In the present exemplary embodiment, when the control unit 17 obtains the perforation failure information, the control unit 17 is configured to control the perforation member moving section 15 so that the shear force is again imparted to the medium P after a preset first period of time elapsed since the perforation failure information was obtained.

Figure 6:
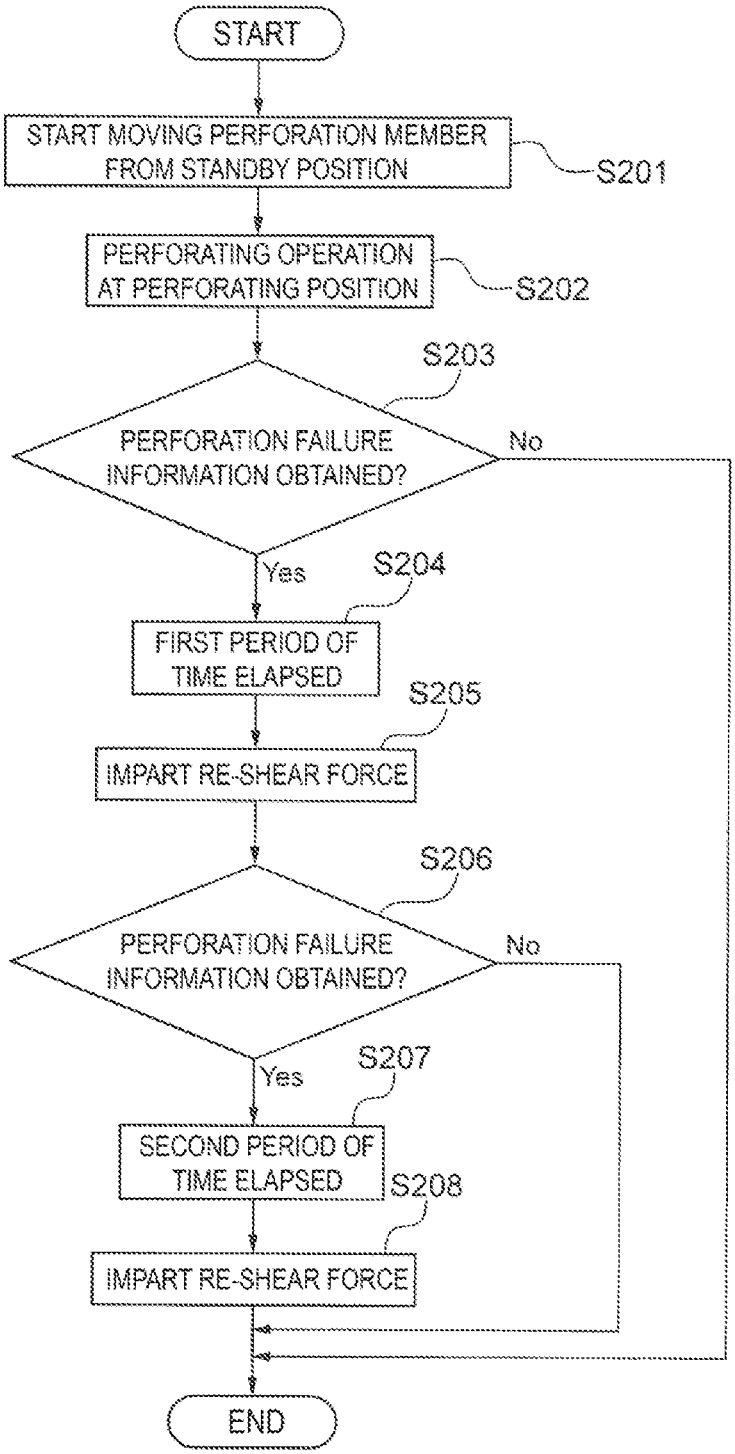
FIG. 6 is a flowchart illustrating perforating operation of a post-processing device according to a third exemplary embodiment.

Specifically, in step S201 in the flowchart of FIG. 6, the perforation member 11 starts to move from the standby position in FIG. 1 toward the die hole 13. The perforation member 11 reaches the inlet of the die hole 13 to perform the perforating operation in which the hole is pierced with respect to the medium P. That is, in step S202, the perforation member 11 performs the perforating operation at the perforating position.

Next, in step S203, it is determined whether the control unit 17 has obtained the perforation failure information during the perforating operation. When perforation failure information has not been obtained, the perforation was performed to form the normal hole 18, and the perforation is completed.

In step S203, when the control unit 17 obtains the perforation failure information, the perforation operation of the perforation member 11 is stopped in step S204, and the stopped state is maintained until the predetermined first period of time has elapsed. While the first period of time elapses, drying of the medium P proceeds. As the drying proceeds, it becomes easier to remove the chads 14. After this first period of time has elapsed, the process proceeds to step S205 to impart the shear force again to the medium P.

Note that, when imparting the shear force again, the transition procedure to a state in which the shear force can be imparted again to the perforation member 11 in a case where the perforation member 11 stops in the perforating position by the chads 14 is the same as in the first exemplary embodiment, and therefore, for simplicity of description, the description thereof is omitted.

Furthermore, in the present exemplary embodiment, when the control unit 17 obtains second perforation failure information upon imparting the shear force again to the medium P after the first period of time elapsed, the control unit 17 is configured to control the perforation member moving section 15 so that the shear force is again imparted to the medium P after a preset second period of time elapsed since the second perforation failure information was obtained.

Specifically, in step S206 of FIG. 6, it is determined whether the control unit 17 has obtained the second perforation failure information while imparting the shear force again. When the second perforation failure information has not been obtained, the perforation was performed to form the normal hole 18, and the perforation is completed. In step S206, when the control unit 17 obtains the second perforation failure information, the perforation operation of the perforation member 11 is stopped in step S207, and the stopped state is maintained until the predetermined second period of time has elapsed. While the second period of time elapses, drying of the medium P proceeds. After this second period of time has elapsed, the process proceeds to step S208 to impart the shear force again to the medium P.

Further, in the present exemplary embodiment, the second period of time is set to be greater than the first period of time. Furthermore, the control unit 17 is configured to be adjustable according to an amount of the liquid 3 discharged onto the medium P for the first period of time and the second period of time.

Description on Effects of Third Exemplary Embodiment (1) According to the present exemplary embodiment, when the control unit 17 obtains the perforation failure information by the control unit 17, the shear force is again imparted to the medium P after the preset first period of time elapsed since the perforation failure information was obtained. As a result, the medium P onto which the liquid 3 is discharged is dried while the first period of time elapses, and thus an effect is obtained in which the chads 14 are easily removed by imparting the shear force again.

(2) In addition, according to the present exemplary embodiment, when the second perforation failure information is obtained, the shear force is again imparted to the medium P after the preset second period of time elapsed since the second perforation failure information was obtained. As a result, the medium P onto which the liquid 3 is discharged is further dried while the second period of time elapses, and thus an effect is obtained in which the chads 14 are easily removed by imparting the shear force again thereafter.

(3) In addition, according to the present exemplary embodiment, the second period of time is longer than the first period of time, so the drying time after obtaining the second perforation failure information is greater than the first drying time, whereby the shear force is subsequently imparted again thereafter to obtain an effect of facilitating removal of the chads 14.

(4) Further, according to the present exemplary embodiment, the first period of time and the second period of time can be adjusted according to the amount of the liquid 3 discharged onto the medium P. As a result, the drying time can be determined according to the amount of moisture of the medium P, which makes it easier to remove the shear debris 14.

Other Exemplary Embodiments

The post-processing device 7 and the liquid discharge device 1 according to the exemplary embodiments of the present disclosure basically have the above-described configuration. However, it is of course possible to change or omit a partial configuration within a range that does not deviate from the gist of the present disclosure.

What is claimed is:

1. A post-processing device comprising:

a placement table configured to place a medium onto which liquid is discharged;

a perforation member configured to perform perforation by imparting a shear force to the medium placed at the placement table;

a die hole provided at the placement table;

a perforation member moving section configured to move the perforation member between a standby position above the die hole and a perforating position at which the perforation member enters the die hole; and a control unit configured to control operation of the perforation member moving section, wherein when the control unit obtains perforation failure information during perforating operation in which the perforation member starts moving from the standby position and moves through the perforating position to the standby position, the control unit controls the perforation member moving section so that a shear force is again imparted to the medium.

2. The post-processing device according to claim 1, wherein when the control unit obtains the perforation failure information, the control unit controls the perforation member moving section so that a shear force is again imparted to the medium after a preset first period of time elapses from the time when the perforation failure information is obtained.

3. The post-processing device according to claim 2, wherein when the control unit obtains second perforation failure information upon imparting a shear force again to the medium after the first period of time elapses, the control unit controls the perforation member moving section so that a shear force is again imparted to the medium after a preset second period of time elapses from the time when the second perforation failure information is obtained.

4. The post-processing device according to claim 3, wherein the second period of time is longer than the first period of time.

5. The post-processing device according to claim 3, wherein the control unit is configured to adjust the first period of time and the second period of time in accordance with an amount of the liquid discharged onto the medium.

6. The post-processing device according to claim 1, comprising a drying mechanism for drying the medium, wherein the control unit is configured to control the drying mechanism, and the control unit control the perforation member moving section so that a shear force is again imparted to the medium after drying the medium by the drying mechanism, when the control unit obtains perforation failure information during the perforating operation of the perforation member.

7. The perforating device according to claim 1, wherein the perforation member is provided rotatably around an axis, and when the control unit obtains perforation failure information during the perforating operation of the perforation member, the control unit controls the perforation member moving section so that a shear force is again imparted to the medium after the perforation member is rotated.

8. The post-processing device according to claim 1, wherein the control unit is configured to change a movement speed of the perforation member by controlling the perforation member moving section, and the control unit control the perforation member moving section so that a shear force is again imparted to the medium by moving the perforation member at a movement speed faster than a movement speed before the perforation failure information is obtained, when the control unit obtains perforation failure information during the perforating operation of the perforation member.

9. The post-processing device according to claim 1, wherein the control unit selectably includes a different location perforation mode in which the medium is perforated at a location different from a perforation location when the control unit obtains the perforation failure information.

10. A liquid discharge device comprising:

a discharge unit configured to discharge liquid onto a medium transported; and a post-processing device configured to perforate the medium onto which the liquid is discharged by the discharge unit, wherein the post-processing device is the post-processing device according to claim 1.

* * * * *